US010471486B2

(12) United States Patent
Vincent et al.

(10) Patent No.: US 10,471,486 B2
(45) Date of Patent: Nov. 12, 2019

(54) METHOD FOR FABRICATION OF A GOLD ALLOY WIRE

(71) Applicant: Nivarox-FAR S.A., Le Locle (CH)

(72) Inventors: Denis Vincent, Neuchatel (CH); Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 531 days.

(21) Appl. No.: 15/342,270

(22) Filed: Nov. 3, 2016

(65) Prior Publication Data

US 2017/0128992 A1 May 11, 2017

(30) Foreign Application Priority Data

Nov. 5, 2015 (EP) ..... 15193182

(51) Int. Cl.

| | |
|---|---|
| ***B21B 1/16*** | (2006.01) |
| ***C22C 5/02*** | (2006.01) |
| ***C22C 30/02*** | (2006.01) |
| ***C22F 1/14*** | (2006.01) |
| ***B21B 3/00*** | (2006.01) |
| ***C22C 9/00*** | (2006.01) |

(52) U.S. Cl.

CPC ..... *B21B 1/16* (2013.01); *B21B 3/00* (2013.01); *C22C 5/02* (2013.01); *C22C 30/02* (2013.01); *C22F 1/14* (2013.01); *C22C 9/00* (2013.01)

(58) Field of Classification Search

CPC ..... B21B 1/16; B21B 3/00; C22F 1/14; C22C 30/02; C22C 5/02; C22C 9/00

See application file for complete search history.

(56) References Cited

U.S. PATENT DOCUMENTS

| | | |
|---|---|---|
| 1,577,995 A | 3/1926 | Wise |
| 3,512,961 A | 5/1970 | Sistare et al. |

FOREIGN PATENT DOCUMENTS

| | | |
|---|---|---|
| AT | 214 156 | 3/1961 |
| EP | 2 045 343 A1 | 4/2009 |
| GB | 1 228 716 | 4/1971 |

OTHER PUBLICATIONS

European Search Report dated May 4, 2016 in European Application 15193182, filed on Nov. 5, 2015 ( with English translation of Categories of Cited Documents).

Greg Normandeau et al. "White Golds: A Question of Compromises", Gold Bulletin, vol. 27, No. 3, 1994, 17 pages.

John Nielsen et al. "Castability Characterization of Gold Jewelry Alloys", Precious Met./ Precious Met., Proc Int. Precious Met Inst Conf 8$^{th}$, 1985, 13 pages.

B. Neumeyer et al. "A facile chemical screening method for the detection of stress corrosion cracking in 9 carat gold alloys", Gold Bulletin, vol. 42, No. 3, 2009, 6 pages.

Olga V. Shulga et al. "Preparation and Characterization of Porous Gold and Its Application as a Platform for Immobilization of Acetylcholine Esterase", Chemistry of Materials, vol. 19, No. 16, 2007, 10 pages.

*Primary Examiner* — Daniel C. McCracken

(74) *Attorney, Agent, or Firm* — Oblon, McClelland, Maier & Neustadt, L.L.P.

(57) ABSTRACT

Method for fabrication of a gold alloy wire:

an alloy is prepared including from 33.33% to 45.83% Au, from 3.64% to 12.44% Zn, from 18.46% to 45.02% Cu, from 9.88% to 33.78% Ni, and from 0.0 to 5.0% of elements from among Ir, In, Ti, Si, Ga, Re, a continuous cast bar is produced, having a diameter of 8.0 to 20.0 mm, this bar is wire rolled while limiting the cross-section deformation to less than 20% per pass, preferably 13%, the cumulative deformation compared to the initial cross-section is measured, the wire rolling is stopped when the cumulative deformation reaches 60% to 75%, an anneal is performed, the wire rolling is started again and the wire rolling, measuring, annealing process is repeated until the desired cross-section is achieved, the intermediate product is drawn to obtain a section wire of circular cross-section.

17 Claims, 1 Drawing Sheet

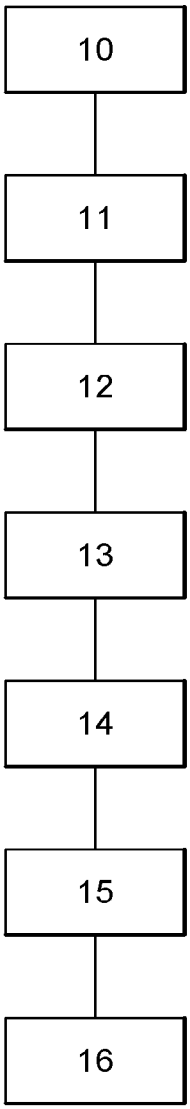
10
11
12
13
14
15
16

METHOD FOR FABRICATION OF A GOLD ALLOY WIRE

This application claims priority from European Patent Application No. 15193182.1 filed on Nov. 5, 2015, the entire disclosure of which is hereby incorporated herein by reference.

FIELD OF THE INVENTION

The present invention relates to a method for fabrication of a cast 8 to 11 carat gold alloy wire with an initial diameter less than or equal to 20 mm in order to obtain a wire whose final diameter is comprised between the initial cast diameter and 0.1 mm.

The invention concerns the field of alloy metallurgy for watchmaking and jewelry.

BACKGROUND OF THE INVENTION

There are two main sorts of grey gold alloys on the market: alloys in which the whitening metal for the gold is nickel, and those where this metal is palladium.

Although less commonly used in jewelry, because of their allergenic properties, alloys of nickel can still be used in watchmaking for components that never come into contact with the skin. Further, the low material cost of nickel compared to palladium makes such alloys advantageous for these watchmaking applications.

However, each of these gold alloys has drawbacks.

Indeed, although these gold-nickel alloys exhibit very low chromaticity, which makes them very attractive for their relative whiteness, they can only have one shaping mode—lost-wax casting—since in the annealed state they have a high hardness, typically greater than 260 HV for an 18 carat gold alloy with 21% by mass of nickel. This hardness means that they are difficult to cold work and are therefore unsuitable for the working conditions of jewelers and manufacturers of external timepiece parts, such as watch cases, hands, dial appliques, etc., who are the main users of such alloys. It was noted, in particular, during tests on these gold-nickel alloys, that they are susceptible to cracking during cold drawing operations and during heat/hardening treatments, and during recrystallization annealing after deformation, particularly when the nickel content exceeds 5% by mass.

It will also be noted that alloys with a relatively low gold content, typically 9 carat gold alloys, are susceptible to cracking corrosion under stress, as described, for example, by B. Neumeyer in the publication entitled "A facile chemical screening method for the detection of stress corrosion cracking in 9 carat gold alloys", Gold Bulletin, volume 42, No. 3 2009. This document discloses, in particular, at page 75, Table 1, a 10 carat gold alloy, containing 10.3 to 20% Ni, 25.2 to 41.6% Cu, and 4.3 to 13.1% Zn, which is usable as a wire or as a sheet, and having one preparation method that includes several rolling steps, and annealing in an $N_2$ and $H_2$ atmosphere at 800° C.

Palladium-gold alloys are expensive due to the price of palladium, and because a substantial amount must be added to the alloy to obtain a whitening effect. Further, although the hardness of palladium-gold alloys, typically 120 HV, certainly allows for satisfactory cold working, it is insufficient to meet the necessary requirements for the manufacture of external timepiece parts.

It is difficult to produce nickel-gold alloys by rolling: numerous rolling passes produce undesirable metallurgical defects, thus the malleability of the alloy decreases as the rolling process advances. Unfortunately, recrystallization anneals, performed to restore properties, homogenize the alloy, with hardening, by solution treatment of the nickel, which is unfavourable for subsequent deformations.

BRIEF DESCRIPTION OF THE DRAWINGS

Other features and advantages of the invention will appear upon reading the following detailed description, with reference to the annexed drawings, in which the only FIG. 1 is a block diagram illustrating the steps of the method according to the invention.

SUMMARY OF THE INVENTION

Other elements, such as cobalt, iron and silver may be added, to try to overcome the drawbacks of nickel and palladium and contribute to the whitening effect of the gold alloys. However, it was found that the quantity needed in the alloy, to achieve the colour and ductility properties required for the field of watchmaking and jewelry, led to other drawbacks.

Typically, cobalt, which has properties close to those of nickel, can least partly replace nickel, but this replacement greatly increases most of the mechanical features to the detriment of the ductility of the alloy.

Adding more than a few percent of iron causes a ferromagnetic effect. This effect occurs in both palladium-gold alloys and nickel-gold alloys. This effect may be detrimental for some applications, particularly for use in the watchmaking industry, where the effect of an external magnetic field may disrupt the timekeeping performance of a timepiece movement.

A low silver content does not contribute to the whitening effect, but as it is relatively neutral in the metallurgical properties of gold alloys, it may serve as a balance to complete the fineness composition, with the drawback, over a few percent, of causing the alloy to tarnish, and also of favouring demixing with the ferrous elements: nickel, cobalt and iron, thereby causing the ferromagnetic effect.

The market has already attempted to overcome the aforementioned problems by proposing a white or grey nickel-gold alloy comprising, by mass, between 37.5 and 37.7% gold, around 9% nickel, around 2% palladium, around 9% silver, around 32% Cu and around 10% zinc, the rest consisting of various elements intended to improve the properties of the alloy. This grey gold alloy has good resistance to cracking under various conditions of mechanical stress, particularly fatigue and cold working, however, its relatively low nickel content means that it has a yellow tinted colour, which means it does not meet the whiteness criteria required for use in jewelry or watchmaking.

Another white or grey gold alloy including nickel but free of palladium and of silver has also been tested by the Applicant. This white or grey nickel-gold alloy comprises, by mass, between 37.5 and 37.7% gold, around 19% nickel, around 31% Cu, around 12% zinc and around 0.5% manganese, the rest consisting of various elements intended to improve the properties of the alloy. The brightness and colour of this grey gold alloy meet the criteria required for use in jewelry or watchmaking, but it exhibits poor cracking resistance under various conditions of stress, particularly during recrystallisation heat treatments.

It is therefore an object of the present invention to determine the conditions for obtaining a gold alloy wire that allows white or grey gold alloys to be substantially improved by providing a grey gold alloy that is free of cobalt, free of iron, free of silver and free of palladium and has a high nickel content, making it possible to exclude palladium without reducing the properties of deformability or metallurgical properties of the alloy, and by developing a transformation method in order to obtain a wire of small diameter of good metallurgical quality, which is homogenous and has no microcracks.

To this end, the invention concerns a method for fabrication of a cast 8 to 11 carat gold alloy wire with an initial diameter less than or equal to 20 mm in order to obtain a wire whose final diameter is comprised between the initial cast diameter and 0.1 mm, according to claim 1.

The development of the invention allows the selection of a grey gold alloy that is free of cobalt, free of iron, free of silver and free of palladium and has a high nickel content, whose deformability permits transformation by the cold drawing technique with no risk of cracking, and which is economical to produce and easy to utilise.

One advantage of the present invention is the obtention of a gold alloy wire offering an advantageous compromise between colour and brightness, of sufficient whiteness to meet the aesthetic requirements of the field of external watch parts, and cracking resistance during shaping by cold working.

Another advantage is ease of polishing, and the high level of whiteness obtained after polishing.

DETAILED DESCRIPTION OF PREFERRED EMBODIMENTS

To this end, the present invention concerns a method for fabrication of a cast 8 to 11 carat gold alloy wire with an initial diameter less than or equal to 20 mm in order to obtain a wire whose final diameter is comprised between the initial cast diameter and 0.1 mm.

This method utilises so-called wire rolling technology, which is in fact a drawing technique, where the material is forced to pass in succession through passages of increasingly smaller cross-section, in the form dies.

This method includes the following steps:

(10) an alloy composition is prepared, including in mass percent:

Au: between 33.33% and 45.84%,
Zn: between 3.64% and 12.44%,
Cu: between 18.46% and 45.02%,
Ni: between 9.88% and 33.78%,
and from 0.0 to 5.0% of at least one of the elements chosen from among Ir, In, Ti, Si, Ga, Re,
and the total content of the elements of said alloy being limited to 100% by adjusting the Cu content,

(11) a cast bar is produced by continuous casting, whose cross-section is inscribed in a diameter of between 8.0 to 20.0 mm,

(12) the as-cast bar is wire rolled, preferably in a substantially rectangular cross-section, preferably by turning the intermediate product obtained through a quarter-turn before each rolling pass, and cross-section deformation is limited to a value less than or equal to 20% per pass,

(13) the cumulative deformation of the intermediate product compared to the initial cross-section of the as-cast bar is measured,

(14) the wire rolling is stopped when the cumulative cross-section deformation is comprised between 60% and 75%, in order to anneal an intermediate product of intermediate cross-section at between 600 and 650° C. for 30 minutes under a reducing gas atmosphere, preferably N2+H2,

(15) the wire rolling is started again with the same parameters, the cumulative deformation of the intermediate product compared to the intermediate cross-section is measured, and rolling is stopped when the cumulative cross-section deformation, between the cross-section of the intermediate product and the intermediate cross-section, is comprised between 60% and 75%, to perform an anneal, and the wire rolling, measurement and annealing process is repeated until the desired intermediate product cross-section is reached,

(16) the intermediate product is drawn to return the cross-section to a substantially circular profile and to obtain a section wire.

More particularly, during the wire rolling, cross-section deformation is limited to a value less than or equal to 13% per pass.

Preferably, the number of anneals is limited to three.

In a particular implementation, the number of drawing passes is limited to three.

In a particular implementation, the wire obtained by said drawing passes is re-shaped.

In a particular implementation, the section wire is cut to length when production is complete.

In a particular embodiment, within the alloy composition, the mass percent contents are limited:

Au: between 33.33% and 45.84%,
Zn: between 4.48% and 12.44%,
Cu: between 22.72% and 45.02%,
Ni: between 12.16% and 33.78%, In another particular embodiment, within the alloy composition, the mass percent contents are limited:

Au: between 37.50% and 37.70%,
Zn: between 4.20% and 11.67%,
Cu between 21.23% and 42.21%
Ni: between 11.36% and 31.67%.

In yet another particular embodiment, within the alloy composition, the mass percent contents are limited:

Au: between 41.67% and 42.50%,
Zn: between 3.86% and 10.89%,
Cu: between 19.59% and 39.39%,
Ni: between 10.49% and 29.55%.

In yet another particular embodiment, within the alloy composition, the mass percent contents are limited:

Au: between 33.33% and 45.84%,
Zn: between 3.64% and 10.11%,
Cu: between 18.46% and 36.58%,
Ni: between 9.88% and 27.44%.

More particularly, there is incorporated, into the alloy composition, between 0.002 and 1.000 percent by mass of at least one of the elements Ir, Ti, Si.

More particularly, there is incorporated, into the alloy composition, between 0.30 and 1.00 percent by mass of Si.

More particularly, there is incorporated, into the alloy composition, between 20 and 500 ppm of Ti.

More particularly, there is incorporated, into the alloy composition, between 0.000 and 0.002 percent by mass of Re.

More particularly, there is incorporated, into the alloy composition, between 1.00 and 4.00 percent by mass of In.

More particularly, said wire is made with a diameter greater than or equal to 0.1 mm.

More particularly, said wire is made with a diameter less than or equal to 20.0 mm.

In a preferred implementation, this wire is transformed by stamping to form a dial, or a dial applique, or a hand.

With an alloy conforming to the aforementioned definition, there is obtained a grey gold alloy meeting all the criteria required for alloys intended to be used in the fields of watchmaking and jewelry, particularly as regards colour and brightness and capacity for cold working with no risk of cracking. This is coupled with satisfactory corrosion resistance. It will also be noted that the absence of palladium and silver makes it possible to obtain an economical alloy.

According to a particular embodiment, the gold alloy is a 7 carat alloy and includes, in percent by mass, between 29 and 30% gold, between 4.8 and 13% Zn, between 24.2 and 47% Cu and between 13 and 35% nickel, and possible a maximum of 5% of at least one element selected from Ir, In, Ti, Si, Ga, Re.

According to a particular embodiment, the gold alloy is a 9 carat alloy and includes between 37.5 and 38.5% gold, between 4.2 and 11.5% Zn, between 21.5 and 41.5% Cu and between 11.5 and 31.2% nickel, and possible a maximum of 5% of at least one element selected from Ir, In, Ti, Si, Ga, Re.

According to another embodiment, the gold alloy is a 10 carat alloy and includes, in percent by mass, between 41.5 and 42.5% gold, between 3.9 and 10.7% Zn, between 19.9 and 38.8% Cu and between 10.7 and 29.1% nickel, and possible a maximum of 5% of at least one element selected from Ir, In, Ti, Si, Ga, Re.

According to yet another embodiment, the gold alloy is a 13 carat alloy and includes, in percent by mass, between 54 and 55% Au, between 3.1 and 8.4% Zn, between 15.7 and 30.4% Cu and between 8.4 and 22.8% nickel, and possible a maximum of 5% of at least one element selected from Ir, In, Ti, Si, Ga, Re.

According to a variant of the above embodiments, the gold alloy includes at least one of the elements Ir, Ti, Si, in a proportion, for each element, comprised between 0.002 and 1% by mass, and, when the alloy includes Si, the proportion of Si is preferably comprised between 0.3 and 1% by mass, and, when it includes Ti, the proportion of Ti is preferably comprised between 20 and 500 ppm, and, when it includes Re, the proportion of Re is preferably 0.002% by mass, and, when it includes indium, the proportion of indium is preferably comprised between 1 and 4% by mass.

The gold alloys according to the invention find particular application in the production of components for timepieces or jewelry and in particular in the production of dials, dial appliques and indicator hands for timepieces. In this application, the alloy avoids the need for rhodium plating which is commonly used in the field of watchmaking to give the treated parts a satisfactory white colour and brightness.

To prepare the grey gold alloy composition according to the invention, the procedure is as follows:

The main elements involved in the composition of the alloy have a purity of 999.9 parts per thousand and are deoxidized.

The elements of the alloy composition are placed in a crucible and heated until the elements melt.

The heating is performed in a sealed induction furnace under a nitrogen partial pressure.

The melted alloy is then poured into an ingot mould.

After solidifying, the ingot is water hardened.

The hardened ingot is then cold rolled and then annealed. The work hardening rate between each anneal is from 66 to 80%, and preferably between 60 and 75%.

Each anneal lasts between 20 and 30 minutes and is performed at 650° C. in a reducing atmosphere comprising $N_2$ and $H_2$.

Cooling after the anneals may be achieved by water quenching.

The following examples were produced in accordance with the conditions set out in Table 1 below and all relate to 7 to 13 carat grey gold alloys. The proportions indicated are expressed in mass percent. Table 1 is divided into two parts: alloys strictly according to the invention, and other variants.

TABLE 1

| N° | Au. | Pd. | Ag. | Cu. | Ni. | Zn. | Ti. | Mn. |
|---|---|---|---|---|---|---|---|---|
| Alloys according to the invention | | | | | | | | |
| 3 | 37.70 | 0.00 | 0.00 | 40.30 | 15.00 | 7.00 | 0.00 | 0.00 |
| 4 | 37.60 | 0.00 | 0.00 | 38.40 | 17.00 | 7.00 | 0.00 | 0.00 |
| 5 | 37.60 | 0.00 | 0.00 | 36.40 | 19.00 | 7.00 | 0.00 | 0.00 |
| 8 | 41.70 | 0.00 | 0.00 | 34.00 | 17.75 | 6.55 | 0.00 | 0.00 |
| other variants | | | | | | | | |
| 0 | 37.57 | 2.00 | 9.00 | 31.83 | 9.30 | 10.30 | 0.00 | 0.00 |
| 1 | 37.70 | 0.00 | 0.00 | 30.80 | 19.00 | 12.00 | 0.00 | 0.50 |
| 6 | 29.15 | 0.00 | 0.00 | 41.33 | 21.57 | 7.95 | 0.00 | 0.00 |
| 7 | 54.20 | 0.00 | 0.00 | 26.70 | 14.00 | 5.10 | 0.00 | 0.00 |
| 2 | 37.70 | 0.00 | 0.00 | 31.27 | 19.00 | 12.00 | 0.03 | 0.00 |

Alloy No 0 is a prior art alloy which is not white enough due to lack of nickel and alloys Nos 1 and 2, made and tested by the Applicant, crack during recrystallization heat treatments.

Different compositions of the invention, namely alloys Nos 3 to 8, were developed and deformation tested to meet the three requirements of brightness, whiteness and deformability necessary for alloys intended to be used in the field of watchmaking and jewelry, and were found to be satisfactory.

Table 2 below sets out various properties of the alloys in examples No 0 to No 8 of Table 1. Table 2 provides, in particular, indications relating to the hardness of the alloy in the as-cast, annealed and drawn state, and to the colour measured in a three-axis coordinate system. This three-dimensional measuring system known as CIELab, CIE being the acronym for the International Commission on Illumination and LAB the axes of the three coordinates; the L axis measures the white-black component (black=0; white=100), the a axis measures the red-green component (red=positive values +a; green=negative values −a), and the b axis measures the yellow-blue component (yellow=positive values +b; blue=negative values −b). (cf. Internation standard ISO 7724 established by the International Commission on Illumination).

TABLE 2

| N° | L. | a*. | b*. | Hv cast | Hv annealed | Hv hard drawn | % of hard drawing |
|---|---|---|---|---|---|---|---|
| 0 | 87.66 | 0.72 | 9.16 | 165 | 180 | 300 | 75 |
| 1 | 85.14 | −0.04 | 5.27 | 150 | 180 | 290 | 70 |
| 2 | 85.34 | 0.04 | 5.84 | 140 | 180 | 290 | 70 |
| 3 | 86.05 | 1.05 | 7.01 | 130 | 170 | 280 | 70 |
| 4 | 85.66 | 0.58 | 6.05 | 135 | 170 | 295 | 70 |
| 5 | 86.08 | 0.54 | 5.64 | 180 | 195 | 295 | 70 |

It is clear from Table 2 that the prior art alloy No 0 has a strong b* component which gives it a yellowish appearance that is unacceptable for watchmaking applications, whereas the alloys of the invention No 3 to No 5 have a considerably lower b* component making the yellowish component of the alloy's colour imperceptible to the human eye. Alloys Nos 1 and 2 meet the aesthetic criteria in terms of colour but are not capable of cold mechanical deformation without cracking.

What is claimed is:

1. A method for fabrication of a cast 8 to 11 carat gold alloy wire with an initial diameter less than or equal to 20 mm in order to obtain a wire having a final diameter comprised between the initial cast diameter and 0.1 mm, the method comprising:

preparing an alloy composition comprising, in mass percent:

Au: between 33.33% and 45.84%,
Zn: between 3.64% and 12.44%,
Cu: between 18.46% and 45.02%,
Ni between 9.88% and 33.78%,
and from 0.0 to 5.0% of at least one element selected from the group consisting of Ir, In, Ti, Si, Ga, and Re,
and the total content of the elements of said alloy being limited to 100% by adjusting the Cu content;

producing a cast bar by continuous casting, whose cross-section is inscribed in a diameter of between 8.0 to 20.0 mm;

wire rolling said cast bar in a substantially rectangular cross-section, by turning the intermediate product obtained through a quarter-turn before each wire rolling pass, and cross-section deformation is limited to a value less than or equal to 20% per pass;

measuring the cumulative deformation of the intermediate product compared to the initial cross-section of said as-cast bar;

stopping the wire rolling when the cumulative cross-section deformation is comprised between 60% and 75%, in order to anneal an intermediate product of intermediate cross-section at between 600° C. and 650° C. for 20 to 30 minutes, under a reducing gas atmosphere consisting of $N_2$ and $H_2$, said anneal being followed by gas or water cooling;

starting the wire rolling again with the same parameters, the cumulative deformation of the intermediate product compared to said intermediate cross-section is measured, and rolling is stopped when the cumulative cross-section deformation, between the cross-section of the intermediate product and said intermediate cross-section, is comprised between 60% and 75%, to perform an anneal, and the wire rolling, measurement and annealing process is repeated until the desired intermediate product cross-section is reached; and drawing the intermediate product to return the cross-section to a substantially circular profile and to obtain a section wire.

2. The method according to claim 1, wherein, during the wire rolling, cross-section deformation is limited to a value less than or equal to 13% per pass.

3. The method according to claim 1, wherein the number of said anneals is limited to three.

4. The method according to claim 1, wherein the number of draw passes is limited to three.

5. The method according to claim 1, wherein said wire obtained via said draw passes is re-shaped.

6. The method according to claim 1, wherein said section wire is cut to length when production is complete.

7. The method according to claim 1, wherein, within said alloy composition comprises, in mass percent contents:

Au: between 33.33% and 45.84%,
Zn: between 4.48% and 12.44%,
Cu: between 22.72% and 45.02%, and
Ni: between 12.16% and 33.78%.

8. The method according to claim 1, wherein, within said alloy composition comprises, in mass percent contents:

Au: between 37.50% and 37.70%,
Zn: between 4.20% and 11.67%,
Cu: between 21.23% and 42.21%, and
Ni: between 11.36% and 31.67%.

9. The method according to claim 1, wherein, within said alloy composition comprises, in mass percent contents:

Au: between 37.5% and 38.5%,
Zn: between 4.20% and 11.5%,
Cu: between 21.5% and 41.5%, and
Ni: between 11.5 and 31.2%.

10. The method according to claim 1, wherein, within said alloy composition comprises, in mass percent contents:

Au: between 41.67% and 42.50%,
Zn: between 3.86% and 10.89%,
Cu: between 19.59% and 39.39%, and
Ni: between 10.49% and 29.55%.

11. The method according to claim 1, wherein, within said alloy composition comprises, in mass percent contents:

Au: between 33.33% and 45.84%,
Zn: between 3.64% and 10.11%,
Cu: between 18.46% and 36.58%, and
Ni: between 9.88% and 27.44%.

12. The method according to claim 1, wherein there is incorporated, into said alloy composition, between 0.002 and 1.000 percent by mass of at least one of the elements selected from the group consisting of Ir, Ti, and Si.

13. The method according to claim 1, wherein there is incorporated, into said alloy composition, between 0.30 and 1.00 percent by mass of Si.

14. The method according to claim 1, wherein there is incorporated, into said alloy composition, between 20 and 500 ppm of Ti.

15. The method according to claim 1, wherein there is incorporated, into said alloy composition, between 0.000 and 0.002 percent by mass of Re.

16. The method according to claim 1, wherein there is incorporated, into said alloy composition, between 1.00 and 4.00 percent by mass of In.

17. The method according to claim 1, wherein said wire is transformed by stamping to form a dial, or a dial applique, or a hand.

* * * * *